US005842490A

United States Patent [19]

Jensen

[11] Patent Number: 5,842,490

[45] Date of Patent: Dec. 1, 1998

[54] TOOTHBRUSH WITH DENTAL FLOSS RECEIVING AND HOLDING HANDLE

[76] Inventor: Dale M. Jensen, 29277 Valley Center Rd., Valley Center, Calif. 92082

[21] Appl. No.: 991,577

[22] Filed: Dec. 16, 1997

[51] Int. Cl.[6] ..... A45D 44/18

[52] U.S. Cl. ..... 132/309; 132/323

[58] Field of Search ..... 132/309, 323; 15/167.1, 167.2

[56] References Cited

U.S. PATENT DOCUMENTS

| | | | |
|---|---|---|---|
| 1,312,896 | 8/1919 | Donnelly | 132/309 |
| 1,890,788 | 12/1932 | Landis | 132/309 |
| 2,517,806 | 8/1950 | Streiler | 132/309 |
| 2,819,482 | 1/1958 | Applegate | 15/167.1 |
| 3,393,687 | 7/1968 | Whitman | 132/323 |
| 3,850,182 | 11/1974 | Clark, Jr. | 132/309 |
| 4,020,521 | 5/1977 | Velasquez | 15/167.1 |
| 4,987,910 | 1/1991 | Lowe | 132/309 |
| 5,205,302 | 4/1993 | Lemon et al. | 15/167.1 |
| 5,394,584 | 3/1995 | Breitschmid | 15/167.1 |
| 5,406,965 | 4/1995 | Levine | 132/323 |

*Primary Examiner*—Todd E. Manahan
*Attorney, Agent, or Firm*—Mallinckrodt & Mallinckrodt; Philip A. Mallinckrodt; Robert R. Mallinckrodt

[57] ABSTRACT

A toothbrush that is provided with the usual elongate handle having the usual hang-up hole in the free, hang-up end portion thereof, has a dental floss receiving slot leading from the outer periphery of the hang-up end portion of the handle into the hang-up hole. This enables an end of a length of dental floss to be held pressed against a face of the brush handle by one hand of a user while the opposite end of the length of floss is grasped by the other hand of the user and pulled taut, with a relatively short length portion thereof being pressed into the slot. Neither hand of the user need enter the mouth for flossing purposes, and both are pre-positioned for immediate and effective conjoint use in the flossing of the user's teeth following attachment of a length of dental floss to the user's toothbrush.

6 Claims, 1 Drawing Sheet

TOOTHBRUSH WITH DENTAL FLOSS RECEIVING AND HOLDING HANDLE

BACKGROUND OF THE INVENTION

1. Field

The invention is in the field of toothbrushes having handles provided with means for receiving and holding a length of dental floss for manipulation in the flossing of teeth.

2. State of the Art

Many attempts have been made to provide the handle of a toothbrush with a simple and practical arrangement for receiving and holding a length of dental floss so that it can be maneuvered in the mouth by the user. One such attempt is shown by U.S. Pat. No. 1,890,788 of Dec. 13, 1932 granted to J. A. Landis of Eaton, Ohio. Although many years have passed since that time, such a toothbrush is still not on the market.

SUMMARY OF THE INVENTION

In the making of the present invention, I have been chiefly concerned with providing a structural arrangement for simply and effectively fastening one end portion of a length of dental floss to the usual hang-up hole in the hang-up end portion of the long-time, widely accepted, elongate handle of a conventional toothbrush, thereby enabling effective flossing between teeth in even very small mouths when the free end portion of the length of dental floss is held and pulled tightly to tension the length of dental floss.

This objective has been achieved in accordance with my invention by modifying the usual hang-up end portion of the conventional toothbrush handle by providing a dental floss receiving slot that is open at the outer periphery of such hang-up end portion of the brush handle and extends into the hang-up hole for passage of the floss into such hang-up hole by way of the slot rather than necessitating "threading" of the floss into and through the hole. The slot enables the user to hold with one hand an end of the length of floss pressed against the brush handle below the hang-up hole and to pull the opposite end with the other hand and thereby tension such floss while guiding and pressing a length portion thereof through the slot into the hang-up hole. The floss may then be wrapped several times about the hang-up end of the brush handle for floss securement and for subsequent maneuvering of the floss in the mouth. Under these circumstances, the provision of one or more floss-receiving and holding notches along the handle, somewhat as shown in FIG. 2 or 3 of the aforementioned Landis patent, becomes quite useful (but not absolutely necessary) in the further securement of the wrapped length of dental floss to the brush handle.

The slot is preferably narrow enough for its mutually confronting faces to be, or to press, against each other to normally maintain the slot closed. Under the latter circumstances, it is helpful to provide a V-shaped entry notch at the slot entrance.

THE DRAWING

The best mode presently contemplated for carrying out the invention is illustrated in the accompanying drawing, in which:

FIG. 1 is a pictorial view of a toothbrush of conventional type except for the usual hang-up end of the elongate brush handle being in accordance with a preferred form of the present invention; and FIG. 2, a fragmentary view in front elevation of the hang-up end of the brush handle drawn to a considerably larger scale with an end portion of a length of dental floss passing through the hang-up hole in the brush handle and held by a thumb of a hand of the user pressing it against the confronting face of the brush handle.

DETAILED DESCRIPTION OF THE ILLUSTRATED EMBODIMENT

Figure 1:
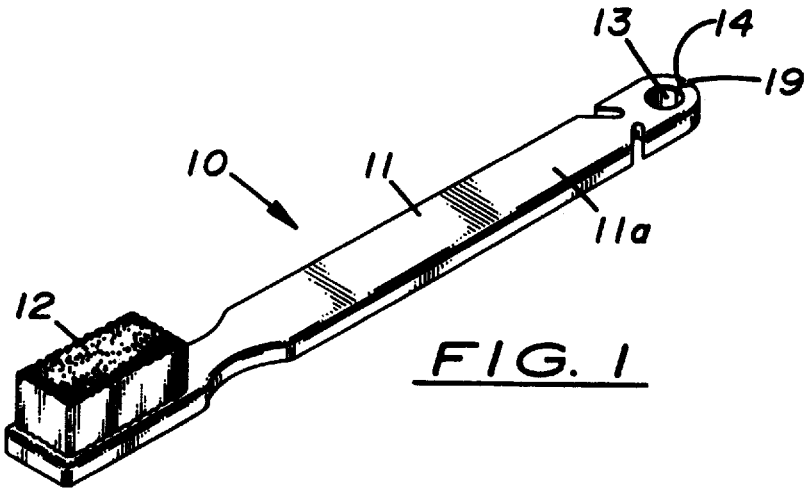

As illustrated, the toothbrush 10 of my invention may be and usually is conventional in all respect, except for the hang-up end 11*a* of the usual elongate brush handle 11 which extends from the usual longitudinal brush 12 and is provided with the usual hang-up hole 13. The free end portion 11*a* of the brush handle customarily has an arcuate periphery around its tip extremity. Although such tip extremity is normally arcuate, usually approximately semi-circular, as shown, it is not necessarily so and may have its periphery of any other geometrical formation.

The unusual thing is that a slot 14 leads from the outer periphery of such hang-up end portion 11*a* of the brush handle along the thickness of such handle into the hang-up hole 13. This enables insertion of a relative short portion of the length of dental floss 15, as held taut, into such hole 13 along the length of the floss, rather than "threading" an end thereof through the hole.

Figure 2:
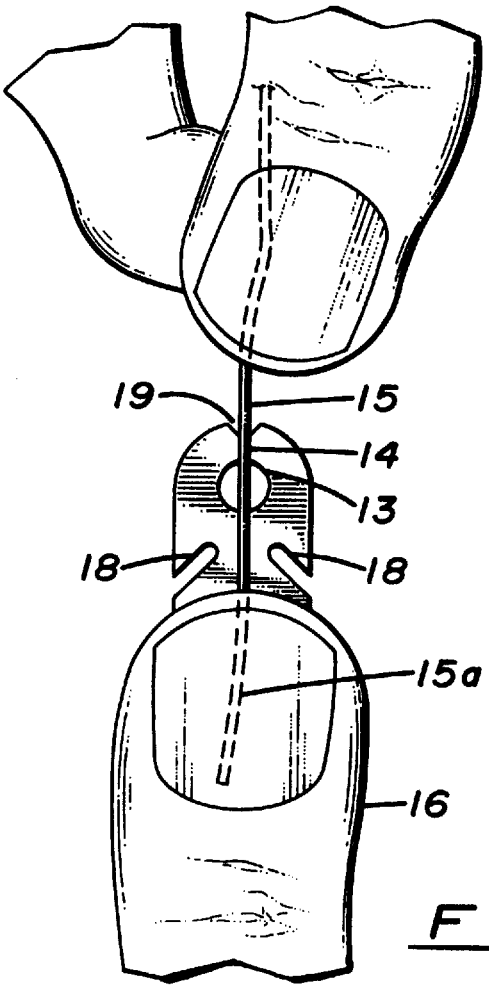

One end 15*a* of the length of floss 15 is conveniently held pressed against a face of the brush handle below the hang-up hole 13 by a thumb 16 of one hand of the user, see FIG. 2, while the other hand of the user grasps the other end portion of the length of floss 15 and pulls such floss length tight while forcing it between mutually adjacent teeth.

It is preferred, though not necessary, to provide the slot during the customary injection molding of the toothbrush handle 11 from a thermoplastic material. However, the slot could be cut into the handle after molding. In any event, it is preferable that the confronting faces of the slot be close together as shown, so as to substantially close the slot, and that a V-shaped entry notch 19 lead into the slot as so closed for ease of insertion of the floss into the slot.

In flossing the teeth, one hand of the user normally holds the toothbrush with its attached length of dental floss, while the other hand holds the free end portion of the length of dental floss, the dental floss being tensioned between such ends for use as previously explained.

For enhancing floss securement, one or more elongate, floss-engaging and holding notches 18 is or are preferably provided in the brush handle preferably adjacent to the hang-up hole 13. Preferably, a pair of such notches are provided in opposite sides, respectively, of the brush handle. If so, the floss need only be wrapped around the handle sufficiently to engage the notch or notches.

Whereas this invention is here illustrated and described with reference to an embodiment thereof presently contemplated as the best mode of carrying out such invention in actual practice, it is to be understood that various changes may be made in adapting the invention to different embodiments without departing from the broader inventive concepts disclosed herein and comprehended by the claims that follow.

Thus, the toothbrush handle 11, altered structurally by the provision of a slot, such as the slot 14, leading into the usual hang-up hole 13, may be used for purposes other than the insertion of dental floss into the hang-up hole. For example, it may be used to insert other items associated with care of the teeth into the hang-up hole. These can be held, if necessary, by pressure against them of the confronting faces of the material of the brush handle that define the slot.

I claim:

1. A toothbrush having an elongate handle with a hang-up hole in its free end; and a slot leading from the outer periphery of said free end of the handle into said hang-up hole along the thickness of said handle, the slot having mutually confronting faces that are normally together to substantially close the slot, and the slot having a V-shaped entry notch leading thereinto.

2. A toothbrush having an elongate handle with a hang-up hole in its free end; and a slot leading from the outer periphery of said free end of the handle into said hang-up hole along the thickness of said handle, so a length of dental floss held taut by the user can be inserted along a portion of its length into and through said slot and into said hole while one end of the length of floss is held against an outer face of said toothbrush handle by one hand of the user for immediate wrapping about said handle by the other hand of the user for securement purposes, at least one dental floss holding notch being provided in the brush handle for receiving the dental floss after positioning in the hang-up hole.

3. A toothbrush according to claim 2, wherein there are a pair of the dental floss holding notches opening into opposite peripheral sides, respectively, of the brush handle.

4. A toothbrush according to claim 3, wherein the pair of dental floss holding notches are adjacent to the hang-up hole of the brush handle.

5. A toothbrush having an elongate handle with a hang-up hole in its free end; and a slot leading from the outer periphery of said free end of the handle into said hang-up hole along the thickness of said handle, so a length of dental floss held taut by the user can be inserted along a portion of its length into and through said slot and into said hole while one end of the length of floss is held against an outer face of said toothbrush handle by one hand of the user for immediate wrapping about said handle by the other hand of the user for securement purposes, the slot having a V-shaped, floss entry notch leading thereinto.

6. A toothbrush having an elongate handle with a hang-up hole in its free end; and a slot leading from the outer periphery of said free end of the handle into said hang-up hole along the thickness of said handle, so a length of dental floss held taut by the user can be inserted along a portion of its length into and through said slot and into said hole while one end of the length of floss is held against an outer face of said toothbrush handle by one hand of the user for immediate wrapping about said handle by the other hand of the user for securement purposes, the floss receiving slot having mutually confronting faces that are normally together to substantially close the slot, and having a V-shaped, floss-entry notch leading thereinto.

* * * * *